US009232617B2

(12) United States Patent
Matsumoto

(10) Patent No.: US 9,232,617 B2
(45) Date of Patent: Jan. 5, 2016

(54) DISCHARGE LAMP ELECTRONIC BALLAST LUMINAIRE AND VEHICLE WITH SAME

(71) Applicant: Panasonic Corporation, Osaka (JP)

(72) Inventor: Koji Matsumoto, Niigata (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 230 days.

(21) Appl. No.: 13/944,182

(22) Filed: Jul. 17, 2013

(65) Prior Publication Data

US 2014/0028188 A1 Jan. 30, 2014

(30) Foreign Application Priority Data

Jul. 24, 2012 (JP) ..... 2012-163844

(51) Int. Cl.

| | |
|---|---|
| ***H05B 37/02*** | (2006.01) |
| ***H05B 41/18*** | (2006.01) |
| ***H05B 41/288*** | (2006.01) |
| *H05B 33/08* | (2006.01) |

(52) U.S. Cl.

CPC ..... *H05B 41/18* (2013.01); *H05B 41/2882* (2013.01); *H05B 33/0815* (2013.01); *H05B 33/0842* (2013.01); *H05B 33/0845* (2013.01); *H05B 33/0851* (2013.01); *H05B 37/0227* (2013.01)

(58) Field of Classification Search

None

See application file for complete search history.

(56) References Cited

U.S. PATENT DOCUMENTS

| | | | | |
|---|---|---|---|---|
| 5,140,229 | A * | 8/1992 | Yagi et al. | 315/307 |
| 5,434,474 | A * | 7/1995 | Ukita et al. | 315/128 |
| 5,705,897 | A * | 1/1998 | Hanazaki et al. | 315/307 |
| 6,046,551 | A * | 4/2000 | Kita | 315/307 |
| 6,288,501 | B1 * | 9/2001 | Nakamura et al. | 315/307 |
| 7,057,358 | B2 * | 6/2006 | Seibt et al. | 315/246 |

(Continued)

FOREIGN PATENT DOCUMENTS

| | | | |
|---|---|---|---|
| JP | 10-162975 | A | 6/1988 |
| JP | 08-31589 | A | 2/1996 |
| JP | 2002-216989 | A | 8/2002 |
| JP | 2005-190927 | A | 7/2005 |

(Continued)

OTHER PUBLICATIONS

Extended European Search Report for corresponding European Application No. 13174827.9 dated Nov. 26, 2013.

*Primary Examiner* — Tuan T Lam

(74) *Attorney, Agent, or Firm* — Renner, Otto, Boisselle & Sklar, LLP

(57) ABSTRACT

Discharge lamp electronic ballast includes DC-DC converter circuit for converting voltage of DC power supply to output DC power, inverter circuit for converting DC power into AC power to supply it to discharge lamp, output feedback control circuit for controlling DC-DC converter circuit, and inverter driving signal generator circuit for controlling inverter circuit. Ballast includes microcomputer having voltage detecting function for detecting voltage value of DC power supply, and ballast temperature detector circuit for detecting temperature of ballast. Microcomputer sets first time based on voltage value of DC power supply and detection result of ballast temperature detector circuit, and reduces power supplied to the discharge lamp if first time elapses from time point when lamp is started, thereby supplying lamp with power for stable operation.

10 Claims, 7 Drawing Sheets

(56) References Cited

U.S. PATENT DOCUMENTS

| | | | | |
|---|---|---|---|---|
| RE42,141 | E * | 2/2011 | Yamamoto et al. | 315/291 |
| 9,024,538 | B2 * | 5/2015 | Saito | 315/307 |
| 2004/0113567 | A1 * | 6/2004 | Yamauchi et al. | 315/291 |
| 2007/0063659 | A1 * | 3/2007 | YAamashita et al. | 315/360 |
| 2007/0138975 | A1 | 6/2007 | Suganuma | |
| 2009/0195176 | A1 | 8/2009 | Suzuki | |
| 2013/0334962 | A1 * | 12/2013 | Nishikawa | 315/82 |
| 2015/0015143 | A1 * | 1/2015 | Inada | 315/77 |

FOREIGN PATENT DOCUMENTS

| | | | |
|---|---|---|---|
| JP | 2009-187708 | A | 8/2009 |
| JP | 2010-231995 | | 10/2010 |
| JP | 2011-113642 | A | 6/2011 |
| JP | 2011-113643 | A | 6/2011 |
| WO | WO 2005/064997 | A1 | 7/2005 |

* cited by examiner

DISCHARGE LAMP ELECTRONIC BALLAST LUMINAIRE AND VEHICLE WITH SAME

TECHNICAL FIELD

The invention relates to a discharge lamp electronic ballast, and luminaire and vehicle with the same.

BACKGROUND ART

Conventionally, there is provided a discharge lamp electronic ballast configured to convert DC power (direct-current power) from a DC power supply into AC power (alternating-current power) to power an HID lamp (a high intensity discharge lamp) or the like, i.e., supply the AC power thereto.

HID lamps such as metal-halide lamps with high luminous flux are used for vehicles. In mainly used conventional lamps, mercury is enclosed in such a lamp in order to start the lamp to increase its luminous flux and stabilize the lamp so that a voltage across electrodes of the lamp is set to be rather high. A lamp in which mercury is enclosed is called a D1 or D2 lamp in general, and the D1 lamp has an igniter which is built in the lamp and configured to generate ignition trigger pulses, whereas there is a mercury-free lamp made to replace mercury with other halogen compound from the point of view of an environmental problem, and the market is now expected to expand. The mercury-free lamp is called a D3 or D4 lamp, and the D3 lamp has an igniter which is built in the lamp and configured to generate ignition trigger pulses.

For example, Japanese Patent Application Publication No. 2002-216989 A discloses discharge lamp electronic ballast configured to output a power command larger than a maximum power limit for several second from a point in time when a discharge lamp is lit, and to output a power command corresponding a rated output after several tens of seconds. In this ballast, the maximum power limit is adjusted in response to a temperature detection value from a temperature detector, thereby suppressing the increase of an internal temperature of the ballast.

In an HID lamp for vehicle, there is a problem of increase of the electricity capacity due to a ballast, wiring or the like, and generation of heat, because if the mercury evaporates, a lamp voltage decreases (e.g., from 85V to 42V) and a lamp current needs to be increased in general. In addition, if the discharge lamp electronic ballast is miniaturized, the temperature of the ballast increases, and accordingly the output to the lamp needs to be decreased, but an excessive decrease of the output may cause lamp flicker, and lamp going out during operation (hereinafter referred to as a "lamp-out").

SUMMARY OF INVENTION

It is an object of the present invention to reduce a thermal stress on electrical parts while suppressing lamp flicker and lamp-out.

A discharge lamp electronic ballast (A1) of the present invention comprises a DC-DC converter circuit (2) configured to convert a voltage of a DC power supply (1) so as to output DC power, an inverter circuit (3) configured to convert the DC power into AC power to supply the power to a discharge lamp (12), and a controller (200) configured to control the DC-DC converter circuit (2) and the inverter circuit (3). The controller (200) comprises a voltage detector (101) configured to detect a voltage value of the DC power supply (1) or a value corresponding to the voltage value, and a temperature detector (10) configured to detect a temperature of the ballast (A1) or a value corresponding to the temperature of the ballast. The controller (200) is configured: (a) when the discharge lamp (12) is started, to supply the discharge lamp (12) with power larger than power to be supplied during a stable operation of the discharge lamp (12); and (b) to reduce the power supplied to the discharge lamp (12) if a first time elapses from a start of the discharge lamp (12), thereby supplying the lamp (12) with power for the stable operation. The controller (200) is configured to set the first time based on a detection result of the voltage detector (101) and a detection result of the temperature detector (10).

In an embodiment, the controller (200) is configured to supply the discharge lamp (12) with power equal to or larger than a fixed value until the first time elapses from the start of the discharge lamp (12).

In an embodiment, the controller (200) is configured to set a reducing rate and a reduced volume of the power supplied to the discharge lamp (12) after the first time elapses based on the detection result of the voltage detector (101).

In an embodiment, the controller (200) is configured to set a reducing rate of the power supplied to the discharge lamp (12) after the first time elapses based on the detection result of the temperature detector (10).

In an embodiment, the controller (200) has reducing rates of the power supplied to the discharge lamp (12), said reducing rates corresponding to detection results of the voltage detector (101) or detection results of the temperature detector (10).

In an embodiment, the controller (200) stores a reference curve of power and is configured to set the reduced volume of the power supplied to the discharge lamp (12) based on the curve of power.

In an embodiment, the controller (200) comprises a lower limit for the reduced volume of the power supplied to the discharge lamp (12), said lower limit corresponding to detection results of the voltage detector (101) or detection results of the temperature detector (10).

A luminaire (B) of the present invention comprises the discharge lamp electronic ballast (A1).

A vehicle (C) of the present invention comprises the luminaire (B).

When the temperature of the ballast is a high temperature and the voltage of the DC power supply is a low voltage, it is possible, by shortening the first time, to bring forward the time when the power supplied to the discharge lamp is reduced, thereby reducing a thermal stress on electrical parts. It is also possible to suppress lamp flicker and lamp-out, because the voltage higher than that to be supplied during the stable operation of the discharge lamp is supplied until the first time elapses.

BRIEF DESCRIPTION OF DRAWINGS

Preferred embodiments of the invention will now be described in further details. Other features and advantages of the present invention will become better understood with regard to the following detailed description and accompanying drawings where.

DESCRIPTION OF EMBODIMENTS

First Embodiment

Figures 1A, 1B:
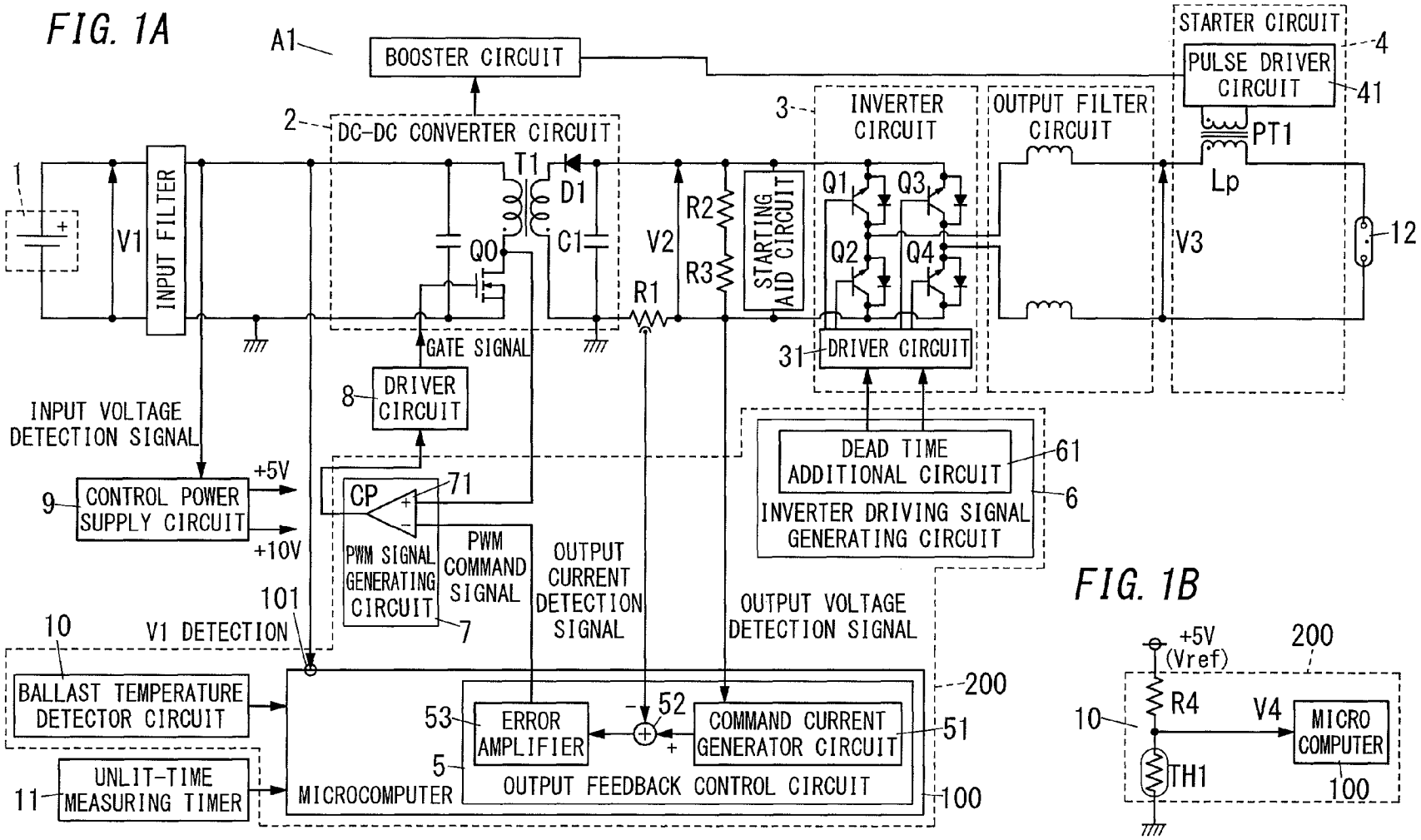
FIG. 1A is a schematic circuit diagram of a discharge lamp electronic ballast in accordance with a first embodiment of the present invention.
FIG. 1B is a schematic circuit diagram of a temperature detector in the ballast.

A discharge lamp electronic ballast (hereinafter called a "ballast") (A1) of the present embodiment includes a DC-DC converter circuit ("converter") (2), an inverter circuit ("inverter") (3) and a controller (200). The converter (2) is configured to convert a voltage (V1) of a DC power supply (1) so as to output DC power (V2). The inverter (3) is configured to convert the DC power (V2) into AC power (V3) to supply the power (V3) to a discharge lamp ("lamp") (12). The controller (200) has a voltage detector (101) and a temperature detector (10), and is configured to control the converter (2) and the inverter (3). The voltage detector (101) is configured to detect a voltage value (V1) of the DC power supply (1) or a value corresponding to the voltage value. The temperature detector (10) is configured to detect a temperature of the ballast (A1) or a value corresponding to the temperature of the ballast (A1). The controller (200) is configured: (a) when the lamp (12) is started, to supply the lamp (12) with power larger than power to be supplied during a stable operation of the lamp (12); and (b) to reduce the power supplied to the lamp (12) if a first time elapses from a start of the lamp (12), thereby supplying the lamp (12) with power for the stable operation. The controller (200) is further configured to set the first time based on a detection result of the voltage detector (101) and a detection result of the temperature detector (10).

Specifically, as shown in FIG. 1A, the ballast A1 includes the converter 2, the inverter 3, a starter circuit (hereinafter called a "starter") 4, an inverter driving signal generator circuit (a "driving signal generator") 6, an output feedback control circuit 5, a PWM (pulse width modulation) signal generator circuit (a "PWM signal generator") 7, a driver circuit (a "driver") 8, a control power supply circuit (a "control power supply") 9, a ballast temperature detector circuit (the temperature detector) 10, and an unlit-time measuring timer (a "timer") 11, and is configured to power an HID (high intensity discharge) lamp or the like, i.e., the lamp 12 as a load.

The converter 2 is a flyback converter, and formed of a transformer T1; a switching device Q0 which is connected in series with a primary winding of the transformer T1 and, along with the primary winding, connected between two output ends of the DC power supply 1; a diode D1 connected in series with a secondary winding of the transformer T1; and a capacitor C1 connected between two ends of the secondary winding of the transformer T1 through the diode D1. The converter 2 is configured to turn the switching device Q0 on and off in accordance with a PWM signal from the PWM signal generator 7. In this configuration, a voltage is induced across the secondary winding of the transformer T1 to be rectified and smoothed through the diode D1 and the capacitor C1. As a result, DC power with a desired voltage value V2 is sent out.

The inverter 3 is a full bridge inverter including four switching devices Q1-Q4 and has, as output ends to the starter 4, a connection point of the switching devices Q1 and Q2 and a connection point of the switching devices Q3 and Q4. The paired switching devices Q1 and Q4 and the paired switching devices Q2 and Q3 are alternately turned on and off through a driver circuit 31 in response to a driving signal generated through the driving signal generator 6. As a result, the DC power with the voltage value V2 from the converter 2 is converted into square wave AC power with a voltage value V3 to be sent out.

The starter 4 is configured to generate a high voltage pulse to apply the pulse across the lamp 12. Specifically, the starter 4 is formed of a pulse transformer PT1 of which secondary winding is connected between the output ends of the inverter 3 through the lamp 12, and a pulse driver circuit ("pulse driver") 41 connected with a primary winding of the pulse transformer PT1. The pulse driver 41 supplies the primary winding of the pulse transformer PT1 with a pulse current repeatedly at prescribed intervals, thereby repeatedly generating a high voltage pulse across the secondary winding of the pulse transformer PT1 to ignite the lamp 12 by the high voltage pulse as a kick voltage.

An inverter controller (6) is configured to generate a driving signal and to supply the driving signal to the inverter (3) to activate the inverter (3). Specifically, the inverter controller (6) is configured to generate first and second driving signals to supply the first and second driving signals to the switching devices Q1, Q4 and the switching devices Q2, Q3 of the inverter 3. More specifically, the driving signal generator 6 as the inverter controller is formed of a low frequency oscillator circuit (not shown) configured to oscillate at a low frequency, e.g., a frequency (e.g., 10 s Hz to several kHz) so as to prevent acoustic resonance, a flip flop (not shown), and a dead time additional circuit 61. The driving signal generator 6 is configured to supply the driver circuit 31 with a two-phase clock signal to which a dead time for turning all the switching devices Q1 to Q4 off is added through the circuit 61.

A converter controller (5 and 7) is configured to generate a PWM signal based on an output voltage and an output current of the converter (2) and to supply the PWM signal to the converter (2) to activate the converter (2). In the present embodiment, the converter controller is formed of the output feedback control circuit 5 and the PWM signal generator 7.

The output feedback control circuit 5 is formed of a command current generator circuit 51, a subtracter 52 and an error amplifier 53. The command current generator circuit 51 is configured to equivalently detect a voltage V3 applied across the lamp 12 by detecting the output voltage V2 of the converter 2 to calculate a current command (value) from a power command (value) to be supplied to the lamp 12. The subtracter 52 is configured to equivalently detect an electric current (value) through the lamp 12 by detecting an electric current (value) through the converter 2 (an electric current through a resistor R1) to calculate a difference between the detected value and the current command (value). The error amplifier 53 is configured to amplify the difference to produce a PWM command signal to supply the signal to the PWM signal generator 7. In the embodiment, the output feedback control circuit 5 is formed of a microcomputer 100.

The PWM signal generator 7 includes a comparator 71. A non-inverting input terminal of the comparator 71 is connected with a connection point of the primary winding of the transformer T1 and the switching device Q0, while an inverting input terminal thereof is connected with an output end of the error amplifier 53 of the output feedback control circuit 5. The PWM signal generator 7 is configured to receive the PWM command signal from the output feedback control circuit 5 to produce a PWM signal with a duty ratio for adjusting the output voltage V2 of the converter 2 to a desired voltage value, and then to supply the PWM signal to the driver 8. The driver 8 is configured to turn the switching device Q0 on and off in accordance with the PWM signal from the PWM signal generator 7.

The control power supply 9 is configured to produce control power from the power supply voltage of the DC power supply 1 to supply the control power to each circuit of the ballast A1. For example, in the embodiment, the control power supply 9 is configured to produce a voltage of DC 5V and a voltage of DC 10V. The timer 11 is configured to measure a period of time until the lamp 12 is lit (started) from a point in time when the lamp 12 is extinguished (inactivated). A magnitude of a starting voltage (an ignition voltage) of the lamp 12 is decided in response to the measured period in time.

FIG. 1B is a schematic circuit diagram showing an example of the temperature detector 10. The temperature detector 10 is formed of a series circuit of a fixed resistor R4 and a thermistor TH1, and an electric potential V4 of a connection point of the fixed resistor R4 and the thermistor TH1 is supplied to the microcomputer 100. The microcomputer 100 is configured to calculate a temperature of the ballast A1 based on the electric potential V4. It is preferable that the temperature detector 10 should be mounted on a circuit board (not shown) for the ballast A1. However, the temperature detector 10 may be disposed on a structural member such as a case or the like. In the case where the temperature detector 10 is mounted on the circuit board, it is possible to securely protect the ballast A1 by disposing the detector 10 in the vicinity of a part with a large heating value (e.g., the transformer T1 or the like).

The microcomputer 100 has the voltage detector 101 configured to detect a power supply voltage V1 of the DC power supply 1. For example, the voltage detector 101 is formed of an internal A/D converter of the microcomputer 100. The controller 200 in the present embodiment is mainly formed of the microcomputer 100 (a main controller), and includes the converter controller (5 and 7) and the inverter controller (6) in addition to the voltage detector (101) and the temperature detector (10).

Figure 2:
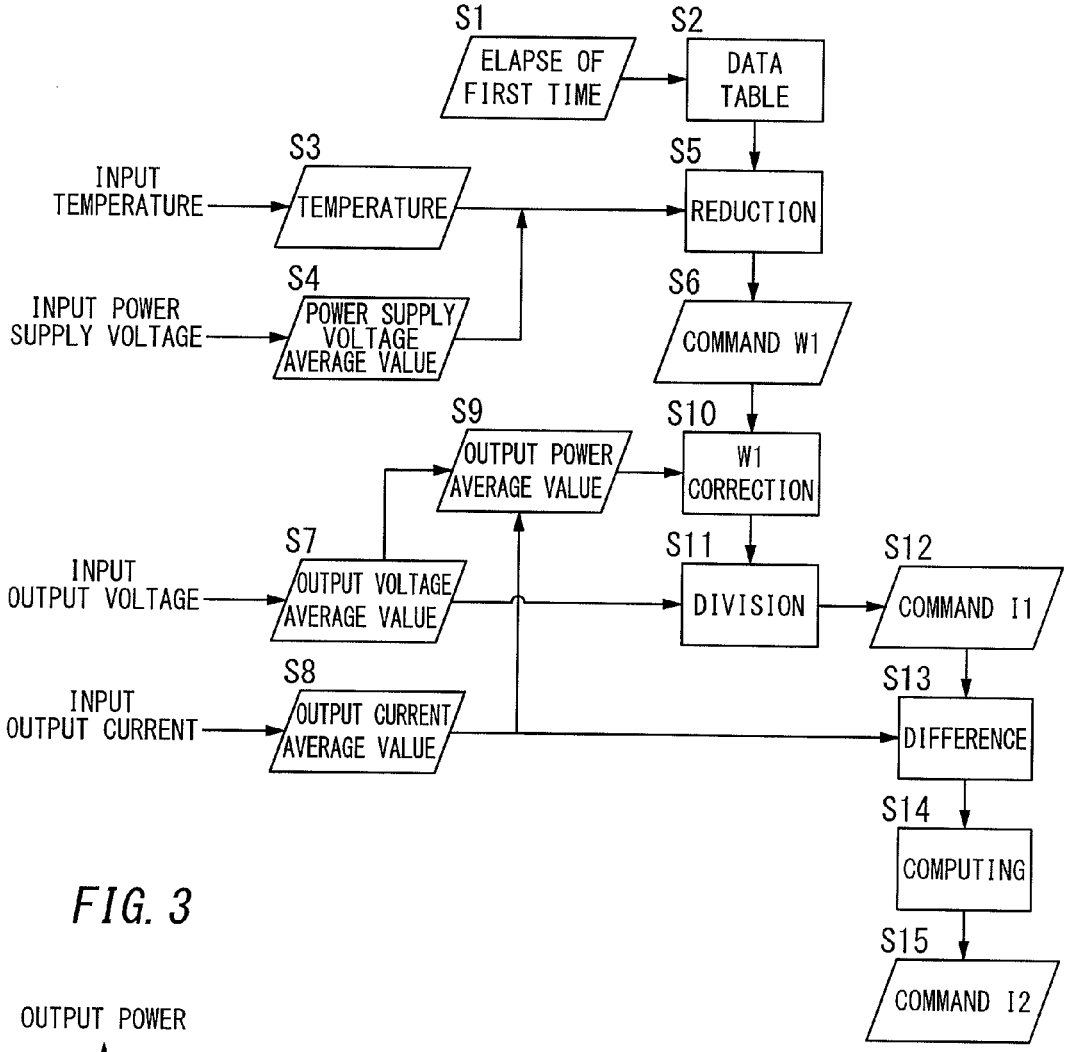
FIG. 2 is an explanatory diagram of the ballast.
Figure 4A:
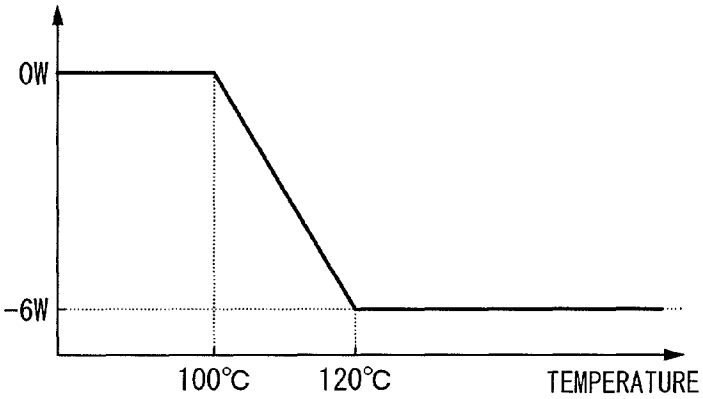
FIG. 4A is a graph depicting a relationship between temperature and reduced volume of the output power.
Figure 4B:
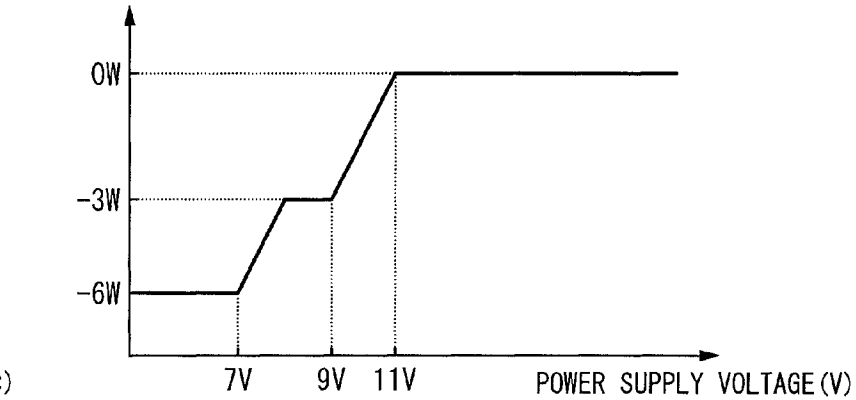
FIG. 4B is a graph depicting a relationship between power supply voltage and reduced volume of the output power.

An operation of the ballast A1 is explained with reference to FIGS. 2 and 4. If a first time elapses from a point in time when a lighting operation of the lamp 12 is started (S1), the microcomputer 100 decides a reduced volume of an output power to be supplied to the lamp 12 based on a data table as shown in FIGS. 4A and 4B (S2, S5). The data table is a data table for stable operation of the lamp 12, and includes a first data table as shown in FIG. 4A and a second data table as shown in FIG. 4B. In other words, the output power for stable operation of the lamp 12 is adaptively set in response to the ballast temperature and the power supply voltage. The first data table includes: a first reduced volume (e.g., 0 W) corresponding to a first ballast temperature range (e.g., 0 to 100° C.); a second reduced volume corresponding to a second ballast temperature range (e.g., 100 to 120° C.); and a third reduced volume (e.g., 6 W) that is larger than the first reduced volume and corresponds to a third ballast temperature range (e.g., more than 120° C.), where the second reduced volume gradually (e.g., linearly) increases from the first reduced volume to the third reduced volume. The second data table includes: a first reduced volume (e.g., 6 W) corresponding to a first power supply voltage range (e.g., 0 to 7V); a second reduced volume corresponding to a second power supply voltage range (e.g., 7V to an intermediate voltage between 7V and 9V); a third reduced volume (e.g., 3 W) that is smaller than the first reduced volume and corresponds to a third power supply voltage range (e.g., the intermediate voltage to 9V); a fourth reduced volume corresponding to a fourth power supply voltage range (e.g., 9V to 11V); and a fifth reduced volume (e.g., 0 W) that is smaller than the third reduced volume and corresponds to a fifth power supply voltage range (e.g., more than 11V), where the second reduced volume gradually (e.g., linearly) decreases from the first reduced volume to the third reduced volume, and the fourth reduced volume gradually (e.g., linearly) decreases from the third reduced volume to the fifth reduced volume.

In this case, the microcomputer 100 is configured to decide the reduced volume of the output power based on the temperature of the ballast A1 from the temperature detector 10 (S3) and the power supply voltage V1 of the DC power supply 1 (S4). For example, when the temperature of the ballast A1 is 120° C. and the power supply voltage V1 is 9V, the total reduced volume of the output power is 9 W (6 W+3 W) from FIGS. 4A and 4B. In this case, if the rated power of the lamp 12 is 35 W, the output power is 26 W (=35 W−9 W).

The microcomputer 100 then calculates a lamp power command (value) W1 based on power command (value) data stored in a memory thereof (not shown) (S6) and also, if the lamp power command W1 is a rated power, limits the lamp power command W1 based on limitation data. The power command data includes a first power value of a maximum power (e.g., 78 W) corresponding to a first time period (e.g., 10 seconds) from a point in time when the lamp 12 is lit, a second power value corresponding to a second time period (e.g., 35 seconds) after the first time period, and a third power value of a rated power (e.g., 35 W) corresponding to a third time period (e.g., 15 seconds) after the second time period, where the second power value gradually decreases from the first power value to the third power value (see "C" of FIG. 3). The limitation data includes a first power value corresponding to a first power supply voltage range (e.g., 0 to 6V), a second power value corresponding to a second power supply voltage range (e.g., 6V to 8V), and a third power value of a rated power (e.g., 35 W) that is larger than the first power value and corresponds to a third power supply voltage range (e.g., more than 8V), where the second power value gradually (e.g., linearly) increases from the first power value to the third power value.

In this case, the microcomputer 100 receives an output voltage V2 (S7) and an output current (S8) of the converter 2 to calculate an output power based on the detection values (S9), and corrects the lamp power command (value) W1 based on the output power (S10). The microcomputer 100 then calculates a lamp current command (value) I1 (S12) by dividing the corrected lamp power command (value) W1 by the output voltage V2 (S11). The microcomputer 100 subsequently calculates a difference between the lamp current command (value) I1 and the output current (value) (S13), and then calculates a command (value) I2 for a primary current of the converter 2 such that the difference becomes zero (S14, S15).

The microcomputer 100 supplies the PWM signal generator 7 with a PWM command signal produced based on the command (value) 12. The PWM signal generator 7 produces a PWM signal in accordance with the PWM command signal, and supplies the PWM signal to the driver 8. The driver 8 turns on and off the switching device Q0 of the converter 2 in accordance with the PWM signal from the PWM signal generator 7. Thus, by controlling the ON time of the switching device Q0 by PWM control, it is possible to control so that the output power supplied to the lamp 12 becomes a fixed value.

Figure 3:
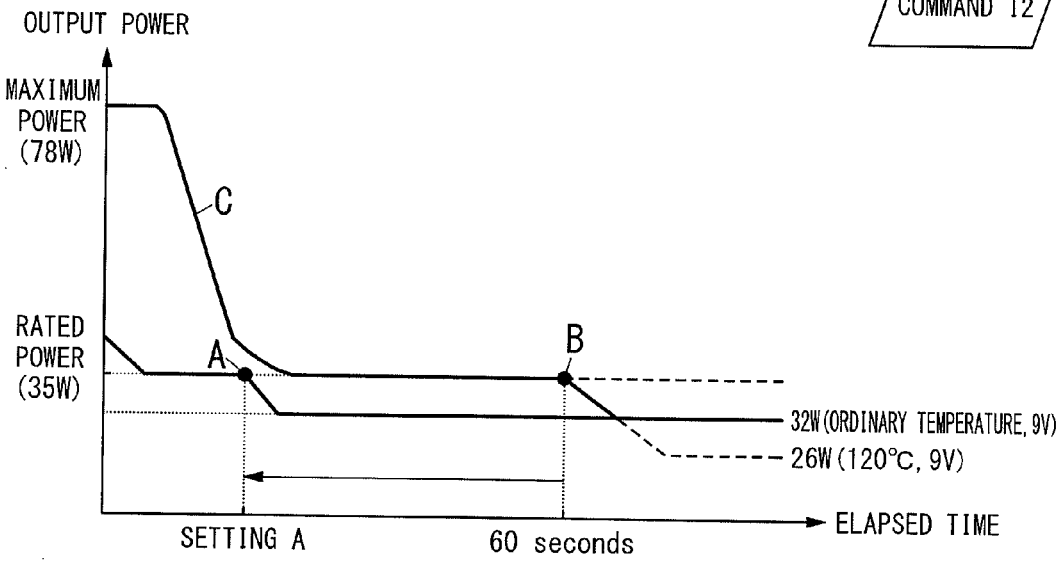
FIG. 3 is a graph depicting a relation between elapsed time and output power.

A start of the lamp 12 from a cold state of an ordinary temperature or the like is called a cold start. In this cold start, the supply power to the lamp 12 is set based on a reference power curve like a solid line C of FIG. 3. That is, the aforementioned power command data is defined by the reference power curve. In addition, the maximum power to the lamp 12 is set based on a graph (maximum power data) as shown in FIG. 4D. The graph (maximum power data) defines a first maximum power corresponding to a first power supply voltage range (e.g., 0 to 7V), a second maximum power corresponding to a second power supply voltage range (e.g., 7 to an intermediate voltage between 7V and 9V), a third maximum power that is larger than the first maximum power and corresponds to a third power supply voltage range (e.g., the intermediate voltage to 9V), a fourth maximum power corresponding to a fourth power supply voltage range (e.g., 9V to 11V), and a fifth maximum power (e.g., 78 W) that is larger than the third maximum power and corresponds to a fifth power supply voltage range (e.g., more than 11V), where the second maximum power gradually (linearly) increases from the first maximum power to the third maximum power, and the fourth maximum power gradually (linearly) increases from the third maximum power to the fifth maximum power. The power during a stable operation of the lamp 12 is set based on FIGS. 4A and 4B.

If the ballast is miniaturized, the temperature of the ballast increases, which causes a large thermal stress on electrical parts of the ballast. Therefore, in the present embodiment, if the first time elapses after a lighting operation of the lamp 12 is started as mentioned above, the output power to the lamp 12 is reduced in response to the temperature of the ballast and the power supply voltage V1. In addition, the reduction of the output power just after the lamp 12 is lit causes lamp flicker and lamp-out. Therefore, like the reference power curve of the solid line C in FIG. 3, after a rated output of 35 W is supplied to the lamp 12 for a fixed time, the output power is decreased, thereby maintaining a steady state in a lighting operation. In the example of FIG. 3 (power supply voltage V1=9V), it is desirable that the first time should be set to about 60 seconds and a rated power (35 W) should be maintained until the first time elapses.

Figure 4C:
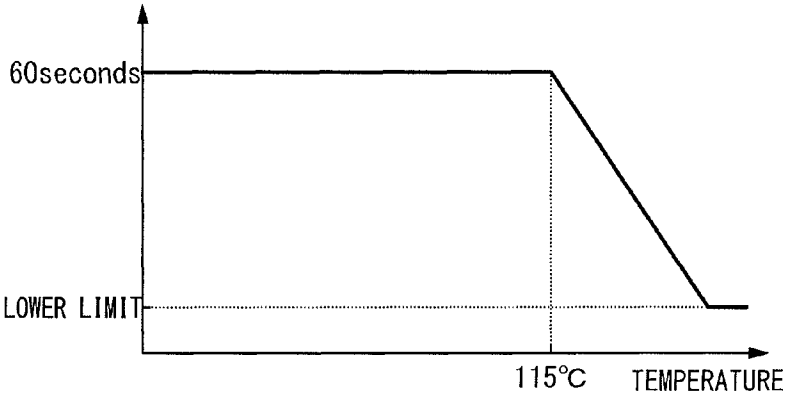
FIG. 4C is a graph depicting a relationship between temperature and begin time of power reduction.
Figure 4D:
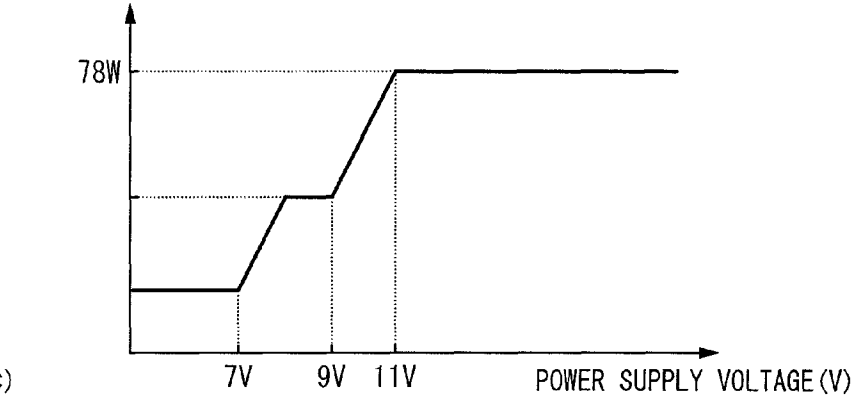
FIG. 4D is a graph depicting a relationship between power supply voltage and maximum power.

FIG. 4C is a graph (first time setting data) depicting a relationship between temperature of the ballast and first time (begin time of power reduction). The graph (first time setting data) for setting the first time defines a first setting value (e.g., 60 seconds) corresponding to a first ballast temperature range (e.g., 0 to 115° C.), and a second setting value corresponding to a second ballast temperature range (e.g., more than 115° C.), where the second setting value gradually (linearly) decreases from the first setting value to a lower limit smaller than the first setting value. If the aforementioned output power for stable operation is adaptively supplied to the lamp 12 just after the lamp 12 is lit, the output power may decrease suddenly, thereby causing lamp flicker and lamp-out. Therefore, in the embodiment, the output power equal to or more than the output power for stable operation (a rated power in the example of FIG. 3) is supplied to the lamp 12 for the first time before the output power for stable operation is adaptively supplied to the lamp 12. The first time is decided based on the ballast temperature(s) obtained from a point in time when the lamp 12 is activated.

When the temperature of the ballast is an abnormal temperature (a malfunction temperature) higher than 115° C., a large temperature stress is put on electrical parts of the ballast. Therefore, the first time is set to a shorter time than 60 seconds. Thus, by shortening the first time when the temperature of the ballast is high, it is possible to reduce the temperature stress on the electrical parts of the ballast. As stated above, the reduction of the lamp power just after the lamp is lit causes lamp flicker and lamp-out. Because of this, the lower limit is provided as shown in the example of FIG. 4C. For example, it is desirable that the lower limit should be set to about 10 seconds.

In the present embodiment, when the temperature of the ballast is a high temperature and the power supply voltage V1 of the DC power supply 1 is a low voltage, the begin time of power reduction can be advanced by shortening the first time. As a result, the temperature stress on electrical parts of the ballast can be reduced. If the power of a fixed value or more (a rated power of 35 W) is supplied to the lamp 12 until the first time for starting power reduction elapses, the temperature of electrodes of the lamp 12 can be increased sufficiently. As a result, it is possible to suppress lamp flicker and lamp-out. In the embodiment, optimum power can be supplied to the lamp 12 in response to the temperature of the ballast and the power supply voltage V1, thereby reducing the temperature stress on electrical parts of the ballast and while suppressing lamp flicker and lamp-out. In the embodiment, the microcomputer 100 has the memory in which the reference power curve is stored, and sets a reduced volume of power supplied to the lamp 12 based on the reference power curve, thereby decreasing the memory capacity in comparison with the case where all reduced volumes are stored in the memory.

In the embodiment, the converter 2 is formed of the flyback converter, but may be formed of, for example, a boost chopper, a buck chopper, or a buck-boost chopper. The inverter 3 is not limited to the full bridge inverter. For example, the inverter 3 may be a half bridge inverter, or may have a shared chopper function. The starter 4 is not limited to the configuration as shown in FIG. 1A. For example, the starter 4 may be an LC resonance voltage type for example. In the embodiment, the temperature detector 10 is formed of the thermistor TH1, but may be an IC for temperature detection or a measuring means for detecting (measuring) temperature such as a configuration in which temperature is calculated based on the ON-resistance of an FET or a diode.

Second Embodiment

A second embodiment of the present invention is explained with reference to FIGS. 1, 5 and 6.

As shown in FIG. 1A, a discharge lamp electronic ballast (hereinafter called a "ballast") A1 of the present embodiment includes a DC-DC converter circuit (a "converter") 2, an inverter circuit (an "inverter") 3, a starter circuit (a "starter") 4, an inverter driving signal generator circuit (a "driving signal generator") 6, an output feedback control circuit 5, a PWM signal generator circuit (a "PWM signal generator") 7, a driver circuit (a "driver") 8, a control power supply circuit (a "control power supply") 9, a ballast temperature detector circuit (a "temperature detector") 10 and an unlit-time measuring timer (a "timer") 11. These circuits are configured in the same way as the first embodiment, and accordingly are not described in detail herein.

Figure 5A:
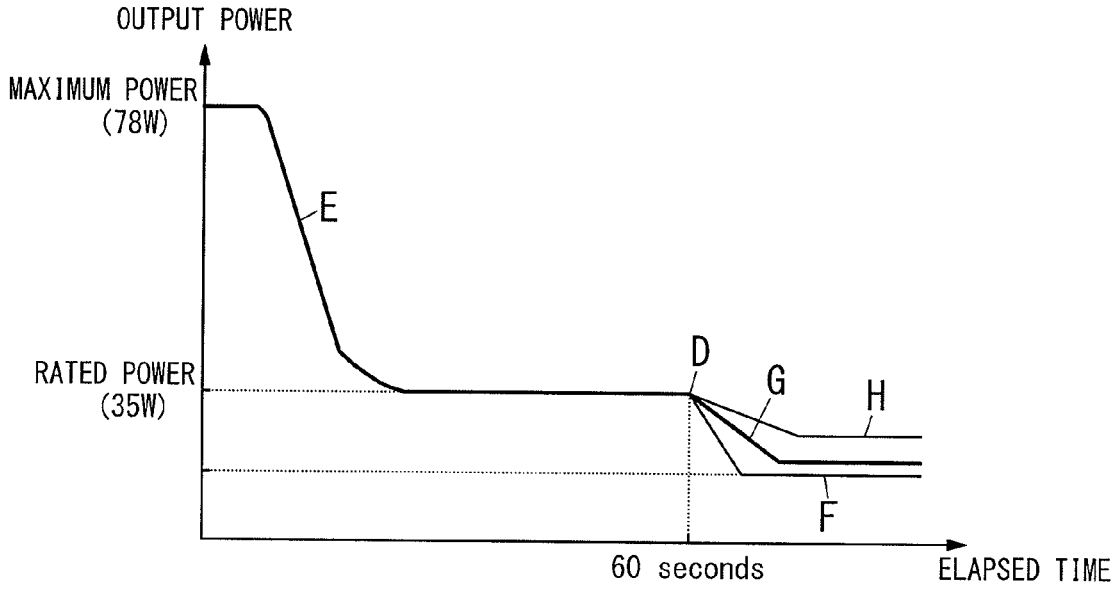
FIGS. 5A and 5B are graphs each of which depicts a relationship between an elapsed time and output power of a discharge lamp electronic ballast in accordance with a second embodiment of the present invention.

FIG. 5A is a graph depicting a relationship between elapsed time and output power of the ballast A1 of the present embodiment. In FIG. 5A, the solid line E shows a reference power curve and the point D shows a start point for starting reducing power (output power) supplied to a discharge lamp (hereinafter called a "lamp") 12. That is, the solid lines F, G and H show an example of the power reducing operation. Specifically, the power reducing operation includes the operations shown in the solid lines F, G and H and other operations, but FIG. 5A omits to show the other operations. In the embodiment, a microcomputer 100 is configured to set a reducing rate and a reduced volume of the output power in response to a magnitude of a power supply voltage V1 of a DC power supply 1. For example, the microcomputer 100 changes the output voltage like the solid line F when the power supply voltage V1 is smaller than a first voltage (e.g., 8V), changes the output voltage like the solid line G when the power supply voltage V1 is equal to a second voltage (e.g., 9V), and changes the output voltage like the solid line H when the power supply voltage V1 is equal to a third voltage (e.g., 10V). The solid line F (first data) defines a first power value that is gradually (linearly) decreases from a rated power (e.g., 35 W) to a first lower limit lower than the rated power with a first slope. The solid line G (second data) defines a second power value that is gradually (linearly) decreases from the rated power to a second lower limit higher than the first lower limit with a second slope lower than the first slope. The solid line H (third data) defines a third power value that is gradually (linearly) decreases from the rated power to a third lower limit higher than the second lower limit with a third slope lower than the second slope. In the example of FIG. 5, as the power supply voltage V1 is smaller, the reducing rate (slope) and the reduced volume of the output power become larger. Thus, the reducing rate and the reduced volume of the output power are increased during a low voltage that causes a large circuit loss, thereby suppressing a thermal stress on electrical parts of the ballast. It is also possible to suppress lamp flicker and lamp-out by reducing the reducing rate and the reduced volume when the power supply voltage V1 is high.

Figure 5B:
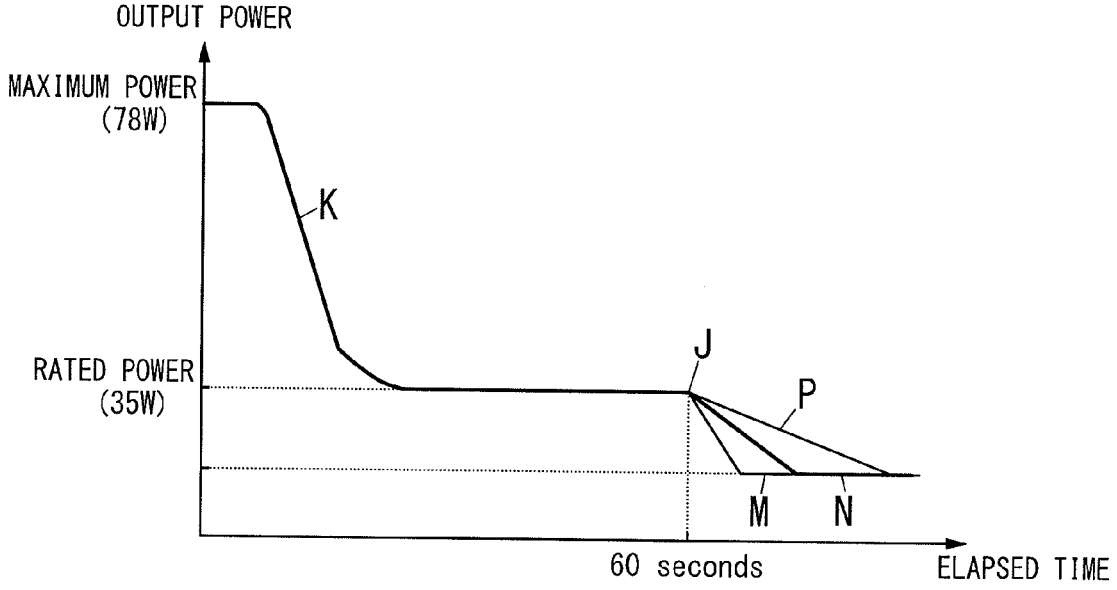
Figure 6:
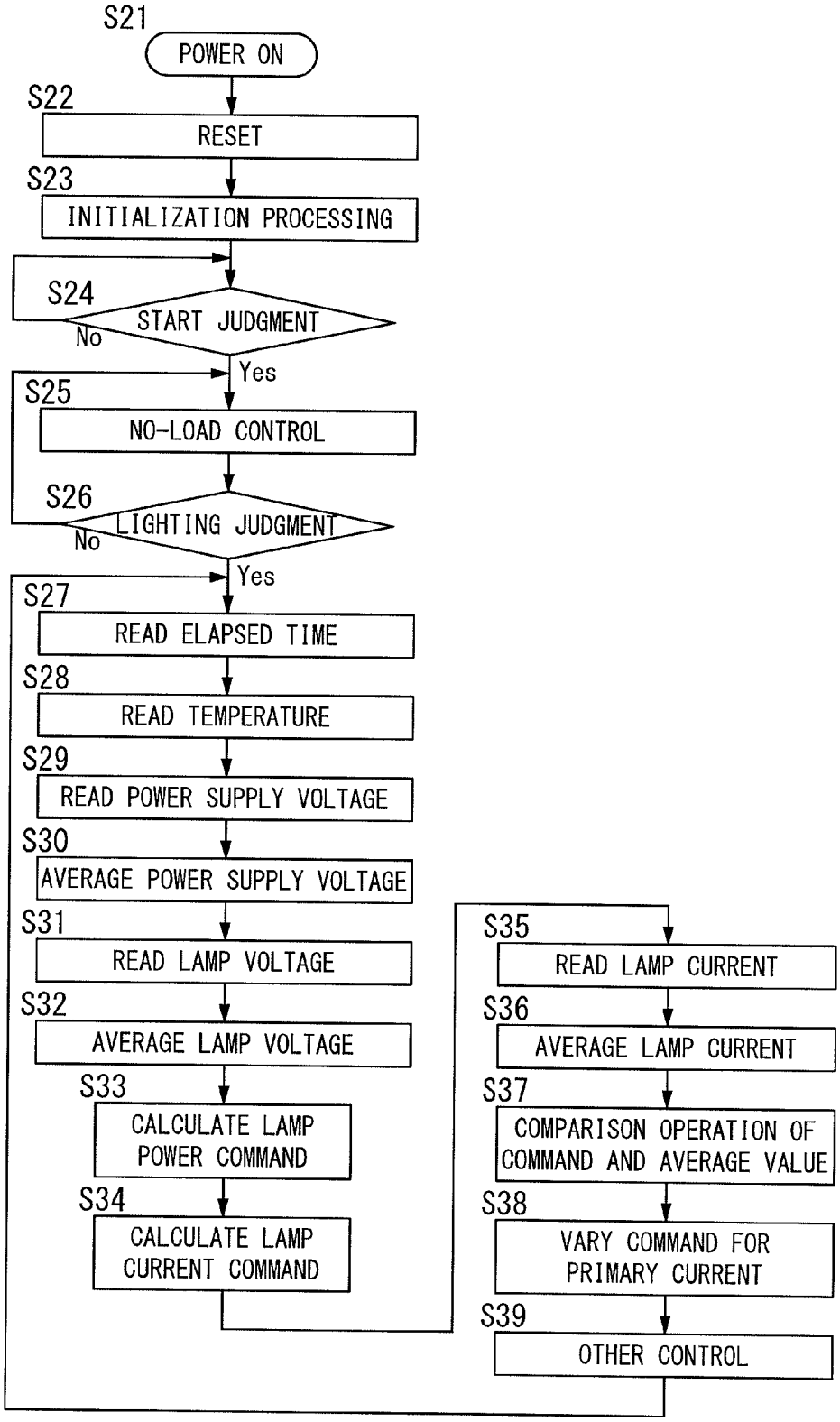
FIG. 6 is a flowchart showing an operation of the ballast in the second embodiment.

FIG. 5B is another graph depicting a relationship between elapsed time and output power of the ballast A1 of the present embodiment. In FIG. 5A, both the reducing rate and the reduced volume of the output power are varied in response to the power supply voltage V1, but in FIG. 5B, only the reducing rate of the output power is varied in response to the temperature of the ballast. That is, the solid lines M, N and P show an example of the power reducing operation. Specifically, the power reducing operation includes the operations shown in the solid lines M, N and P and other operations, but FIG. 5B omits to show the other operations. In the example of FIG. 5B, the microcomputer 100 is configured to vary the output power like the solid line M when the temperature of the ballast is a first temperature (e.g., 105° C.), to vary the output power like the solid line N when the temperature of the ballast is a second temperature (e.g., 95° C.) lower than the first temperature, and to vary the output power like the solid line P when the temperature of the ballast is a third temperature (e.g., 85° C.) lower than the second temperature. The solid line M (first data) defines a first power value that is gradually (linearly) decreases from a rated power (e.g., 35 W) to a lower limit lower than the rated power with a first slope. The solid line N (second data) defines a second power value that is gradually (linearly) decreases from the rated power to the lower limit with a second slope lower than the first slope. The solid line P (third data) defines a third power value that is gradually (linearly) decreases from the rated power to the lower limit with a third slope lower than the second slope. In short, the microcomputer 100 is configured to more increase only the reducing rate (slope) of the output power as the temperature of the ballast is higher. Thus, the reducing rate of the output power is increased during a high temperature that causes a large circuit loss, thereby suppressing a thermal stress on electrical parts of the ballast. It is also possible to suppress lamp flicker and lamp-out by decreasing the reducing rate of the output power when the temperature of the ballast is low.

In the present embodiment, by increasing both the reducing rate and the reduced volume of the output power as the power supply voltage V1 is smaller, or by increasing only the reducing rate of the output power as the temperature of the ballast is higher, it is possible to reduce a thermal stress on electrical parts of the ballast in a high temperature that causes a large circuit loss. As a result, it is possible to prolong the life of the ballast A1.

An operation of the ballast A1 in the present embodiment is explained with reference to a flowchart shown in FIG. 6. If a user switches on a power switch (not shown) of the ballast, the ballast is energized (S21) and the microcomputer 100 is reset (S22) and initializes variables, flags and the like (S23). After the initialization is finished, the microcomputer 100 judges whether or not the lamp 12 should be started (S24). When starting the lamp 12, the microcomputer 100 performs the control for no-load before the lamp 12 is lit (S25). After the control for no-load is finished, the microcomputer 100 judges whether or not the lamp 12 is lit (S26). If the lamp 12 is lit, the microcomputer 100 reads an elapsed time (first time) from a point in time when the lamp 12 is lit (S27).

The microcomputer 100 then reads the temperature of the ballast (S28) and the power supply voltage V1 (S29) of the DC power supply 1 from the temperature detector 10 and the voltage detector 101, respectively, and averages the power supply voltage V1 (S30). The microcomputer 100 equivalently reads a lamp voltage by reading the output voltage of the converter 2 (S31) and average the lamp voltage (S32). The microcomputer 100 then reads a corresponding lamp power command (value) from the data table stored in the memory (not shown) to perform the power limitation based on the temperature of the ballast (S33). The microcomputer 100 then calculates a lamp current command (value) from the lamp power command (value) and the averaged lamp voltage (value) (S34).

The microcomputer 100 equivalently reads a lamp current (value) by reading an electric current (value) through the converter 2 (S35), and averages the lamp current (S36). The microcomputer 100 subsequently compares the averaged lamp current with the calculated lamp current command (value), and varies the command (value) for primary current of the converter 2 in response to the comparison result (S38) while performing other controls such as stopping control based on judgment of abnormal (malfunction) conditions of the load and the power supply, and the like (S39). The microcomputer 100 repeatedly performs the processes of S27 to S39.

Third Embodiment

A third embodiment of the present invention is explained with reference to FIGS. 1, 7 and 8.

As shown in FIG. 1A, a discharge lamp electronic ballast (hereinafter called a "ballast") A1 of the present embodiment includes a DC-DC converter circuit (a "converter") 2, an inverter circuit (an "inverter") 3, a starter circuit (a "starter") 4, an inverter driving signal generator circuit (a "driving signal generator") 6, an output feedback control circuit 5, a PWM signal generator circuit (a "PWM signal generator") 7, a driver circuit (a "driver") 8, a control power supply circuit (a "control power supply") 9, a ballast temperature detector circuit (a "temperature detector") 10 and an unlit-time measuring timer (a "timer") 11. These circuits are configured in the same way as the first embodiment, and accordingly are not described in detail herein.

Figure 7:
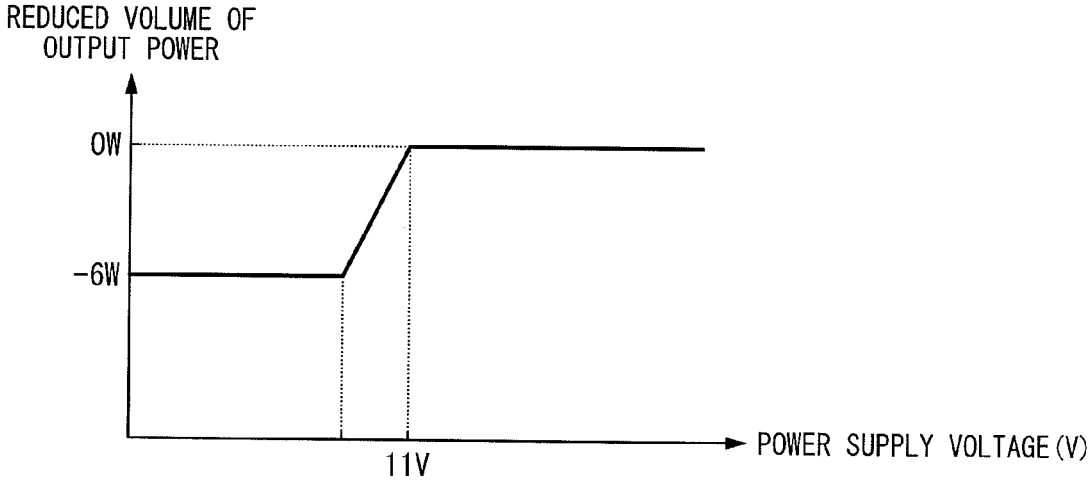
FIG. 7 is a graph depicting a relationship between power supply voltage and reduced volume of output power of a discharge lamp electronic ballast in accordance with a third embodiment of the present invention.
Figure 8:
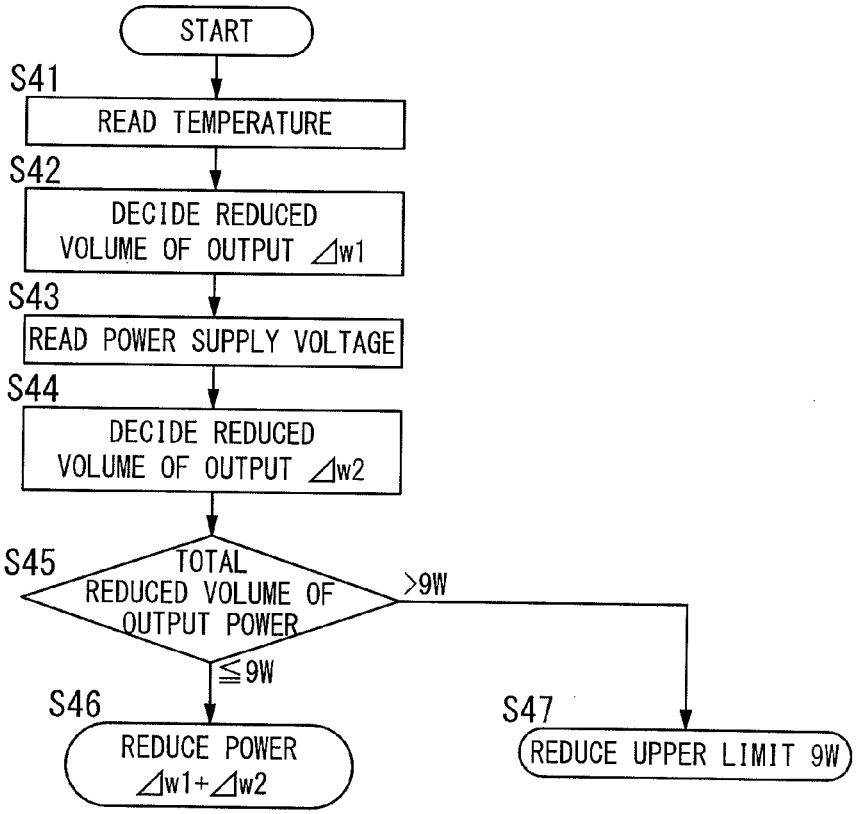
FIG. 8 is a flowchart showing an operation of the ballast in the third embodiment.

FIG. 7 is a graph depicting a relationship between power supply voltage V1 and reduced volume of output power in the ballast A1 of the present embodiment. In the relationship of FIG. 7, the lower limit for the reduced volume is set to −6 W, thereby defining the maximum reduced volume of 6 W. The graph (data) of FIG. 7 defines a first reduced volume corresponding to a first power supply voltage range (e.g., 0 to 11V), and a second reduced volume(e.g., 0 W) that is smaller than the first reduced volume and corresponds to a second power supply voltage range (e.g., more than 11V), where the first reduced volume gradually (linearly) increases from the second reduced volume to a prescribed value (the lower limit) as the power supply voltage more decreases from a maximum value of the first power supply voltage range. FIG. 4A shows a relationship between temperature of the ballast and reduced volume of power (output power) supplied to a discharge lamp (hereinafter called a "lamp") 12. In the relationship of FIG. 4A, the lower limit for the reduced volume is set to −6 W, thereby defining the maximum reduced volume of 6 W. In this case, the maximum total reduced volume is 12 W, but when a rated power is 35 W, the power reduction of 12 W may cause lamp flicker and lamp-out during operation due to a power shortage. Therefore, in the embodiment, the total reduced volume is set to a prescribed value (e.g., 9 W) smaller than the maximum total power reduction (12 W) even when the total reduced volume exceeds 9 W. When the total reduced volume is equal to or less than 9 W, the total reduced volume is used.

An operation of the present embodiment is explained with reference to FIG. 8. The microcomputer 100 reads the temperature of the ballast from the temperature detector 10 (S41) to decide the reduced volume Δw1 of the output power based on the temperature of the ballast (S42). The microcomputer 100 then reads the power supply voltage V1 of the DC power supply 1 (S43) to decide the reduced volume Δw1 based on the power supply voltage V1 (S44). The microcomputer 100 calculates the total reduced volume (Δw1+Δw2). The microcomputer 100 then sets the reduced volume of the output power to the total reduced volume (S46) if the total reduced volume is equal to or less than 9 W (S45), and sets the reduced volume of the output power to 9 W of the prescribed value (the lower limit) (S47) if the total reduced volume exceeds 9 W (S45).

Thus, a minimum power for lighting the lamp 12 can be secured by setting the lower limit of the total reduced volume of the output power. As a result, it is possible to suppress lamp-out to realize stable lighting, and to suppress a temperature stress on electrical parts of the ballast by reducing the output power.

Fourth Embodiment

Figure 9:
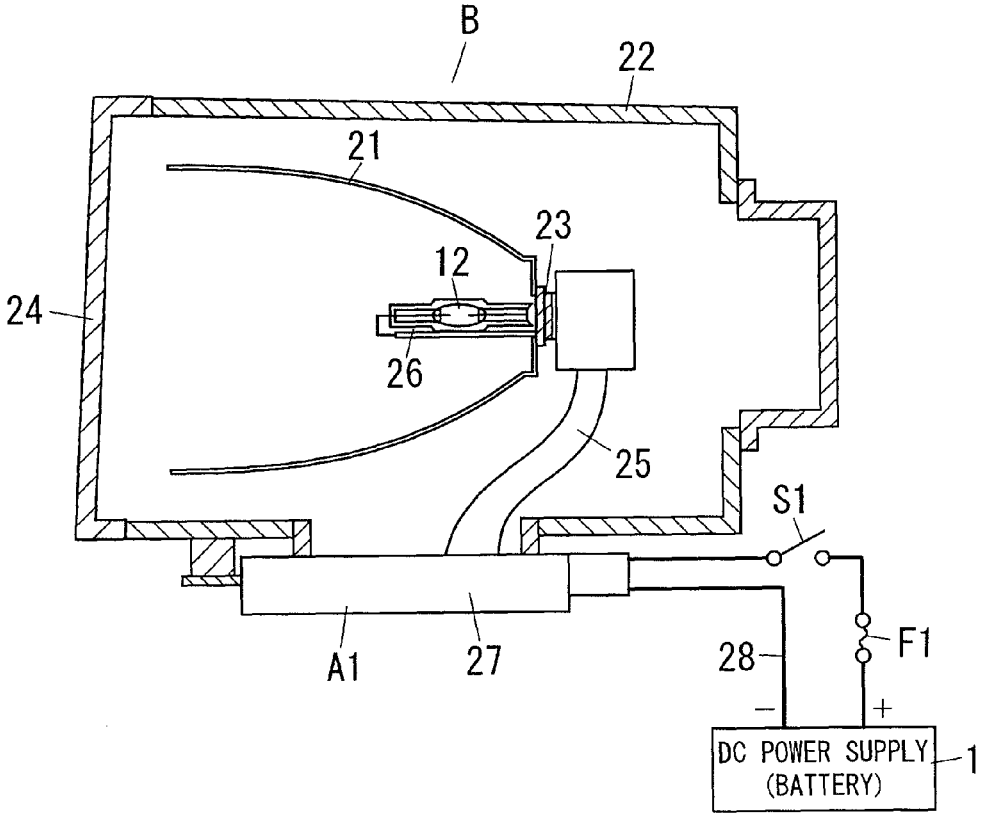
FIG. 9 is a schematic profile of a luminaire with a discharge lamp electronic ballast of any one of the first to third embodiments.
Figure 10:
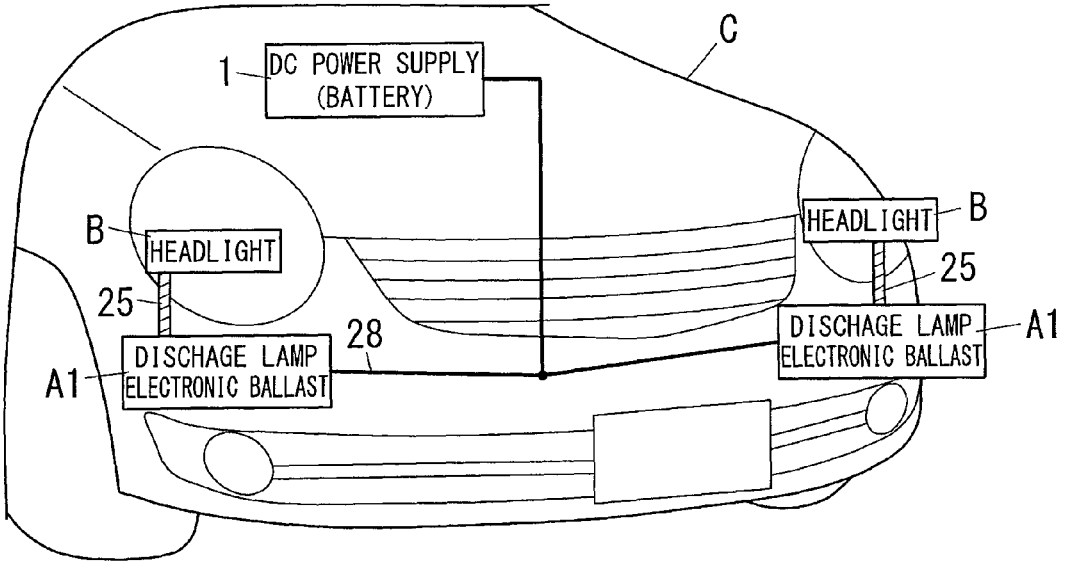
FIG. 10 is a perspective view of part of a vehicle with the luminaire.

FIG. 9 is a schematic profile of a luminaire in the present embodiment, and FIG. 10 is a perspective view of part of a vehicle in the present embodiment.

The luminaire in the present embodiment is, for example, a headlight B provided for a vehicle C. The headlight B has a housing 22 shaped like a case with an opening in a front of the vehicle C (a left face in FIG. 9). The housing 22 houses a discharge lamp 12 connected to a socket 23, a reflector 21 which surrounds the lamp 12 and reflects its light forward, and a shade 26 which is attached to the lamp 12 to prevent glare of the lamp 12. A transparent (or translucent) cover 24 is attached to the front (opening) of the housing 22 so that light from the lamp 12 and light reflected by the reflector 21 passes through the cover 24 to be emitted therefrom.

A ballast A1 in any one of the aforementioned embodiments is put in a case 27, and the case 27 with the ballast A1 is attached to a bottom of the housing 22. The case 27 (the ballast) is connected to the socket 23 through a cable 25. In addition, the ballast A1 is connected with a DC power supply 1 formed of a battery through a lamp switch S1, a fuse F1 and a power line 28.

For example, as shown in FIG. 10, two headlights B are disposed at both sides in the front of the vehicle C, and supplied with AC power from the respective ballasts A1 to emit light of prescribed luminous intensity.

The embodiment includes a ballast A1 in any one of the aforementioned embodiments, and accordingly it is possible to provide the headlights B and the vehicle C capable of reducing a thermal stress on electrical parts of the ballasts while suppressing lamp flicker and lamp-out with respect to the lamps 12.

In the embodiment, the ballast A1 is applied to the headlights B, but may be applied to width indicators, tail lights or other lights.

The invention claimed is:

1. A discharge lamp electronic ballast, comprising:

a DC-DC converter circuit configured to convert a voltage of a DC power supply so as to output DC power;

an inverter circuit configured to convert the DC power into AC power to supply the power to a discharge lamp; and a controller configured to control the DC-DC converter circuit and the inverter circuit, wherein the controller comprises:

a voltage detector configured to detect a voltage value of the DC power supply or a value corresponding to the voltage value; and a temperature detector configured to detect a temperature of the ballast or a value corresponding to the temperature of the ballast, wherein the controller is configured:

during a first time period from a point in time when the discharge lamp is started and a second time period after the first time period, to supply the discharge lamp with power larger than power to be supplied during a stable operation of the discharge lamp;

to supply the discharge lamp with a rated output for a fixed time after the second time period, thereby supplying the discharge lamp with power equal to or larger than a fixed value until a first time elapses from a start of the discharge lamp, the first time including the first time period, the second time period and the fixed time; and to reduce the power supplied to the discharge lamp when the first time elapses from the start of the discharge lamp, thereby supplying the lamp with power for the stable operation, wherein the controller is further configured to set the first time based on a detection result of the voltage detector and a detection result of the temperature detector.

2. The discharge lamp electronic ballast of claim 1, wherein the controller is configured to set a reducing rate and a reduced volume of the power supplied to the discharge lamp after the first time elapses based on the detection result of the voltage detector.

3. The discharge lamp electronic ballast of claim 1, wherein the controller is configured to set a reducing rate of the power supplied to the discharge lamp after the first time elapses based on the detection result of the temperature detector.

4. The discharge lamp electronic ballast of claim 1, wherein the controller has reducing rates of the power supplied to the discharge lamp, said reducing rates corresponding to detection results of the voltage detector or detection results of the temperature detector.

5. The discharge lamp electronic ballast of claim 1, wherein the controller stores a reference curve of power and is configured to set a reduced volume of the power supplied to the discharge lamp based on the curve of power.

6. The discharge lamp electronic ballast of claim 2, wherein the controller stores a reference curve of power and is configured to set the reduced volume of the power supplied to the discharge lamp based on the curve of power.

7. The discharge lamp electronic ballast of claim 1, wherein the controller comprises a lower limit for a reduced volume of the power supplied to the discharge lamp, said lower limit corresponding to detection results of the voltage detector or detection results of the temperature detector.

8. The discharge lamp electronic ballast of claim 2, wherein the controller comprises a lower limit for the reduced volume of the power supplied to the discharge lamp, said lower limit corresponding to detection results of the voltage detector or detection results of the temperature detector.

9. A luminaire, comprising a discharge lamp electronic ballast, wherein the discharge lamp electronic ballast comprises:

a DC-DC converter circuit configured to convert a voltage of a DC power supply so as to output DC power;

an inverter circuit configured to convert the DC power into AC power to supply the power to a discharge lamp; and a controller configured to control the DC-DC converter circuit and the inverter circuit, wherein the controller comprises:

a voltage detector configured to detect a voltage value of the DC power supply or a value corresponding to the voltage value; and a temperature detector configured to detect a temperature of the ballast or a value corresponding to the temperature of the ballast, wherein the controller is configured:

during a first time period from a point in time when the discharge lamp is started and a second time period after the first time period, to supply the discharge lamp with power larger than power to be supplied during a stable operation of the discharge lamp;

to supply the discharge lamp with a rated output for a fixed time after the second time period, thereby supplying the discharge lamp with power equal to or larger than a fixed value until a first time elapses from a start of the discharge lamp, the first time including the first time period, the second time period and the fixed time; and to reduce the power supplied to the discharge lamp when the first time elapses from the start of the discharge lamp, thereby supplying the lamp with power for the stable operation, wherein the controller is further configured to set the first time based on a detection result of the voltage detector and a detection result of the temperature detector.

10. A vehicle, comprising:

a luminaire comprising a discharge lamp electronic ballast, wherein the discharge lamp electronic ballast comprises:

a DC-DC converter circuit configured to convert a voltage of a DC power supply so as to output DC power;

an inverter circuit configured to convert the DC power into AC power to supply the power to a discharge lamp; and a controller configured to control the DC-DC converter circuit and the inverter circuit, wherein the controller comprises:

a voltage detector configured to detect a voltage value of the DC power supply or a value corresponding to the voltage value; and a temperature detector configured to detect a temperature of the ballast or a value corresponding to the temperature of the ballast, wherein the controller is configured:

during a first time period from a point in time when the discharge lamp is started and a second time period after the first time period, to supply the discharge lamp with power larger than power to be supplied during a stable operation of the discharge lamp;

to supply the discharge lamp with a rated output for a fixed time after the second time period, thereby supplying the discharge lamp with power equal to or larger than a fixed value until a first time elapses from a start of the discharge lamp, the first time including the first time period, the second time period and the fixed time; and to reduce the power supplied to the discharge lamp when the first time elapses from the start of the discharge lamp, thereby supplying the lamp with power for the stable operation, wherein the controller is further configured to set the first time based on a detection result of the voltage detector and a detection result of the temperature detector.

* * * * *